US005295818A

United States Patent [19]

Robinson

[11] Patent Number: 5,295,818

[45] Date of Patent: Mar. 22, 1994

[54] CONTROL UNIT FOR BURNER ASSEMBLY

[75] Inventor: Edgar C. Robinson, Vancouver, Canada

[73] Assignee: ITR Holdings Ltd., Vancouver, Canada

[21] Appl. No.: 864,879

[22] Filed: Apr. 6, 1992

[51] Int. Cl.[5] ..... F23N 5/00

[52] U.S. Cl. ..... 431/75; 431/77; 431/78

[58] Field of Search ..... 431/77, 78, 75, 79, 431/25, 27, 66, 80, 69-71

[56] References Cited

U.S. PATENT DOCUMENTS 2,318,195 5/1943 Cate ..... 431/75

4,465,455 8/1984 Meyer ..... 431/78

FOREIGN PATENT DOCUMENTS 108519 7/1982 Japan ..... 431/78

198921 12/1982 Japan ..... 431/78

84023 5/1984 Japan ..... 431/75

123221 6/1987 Japan ..... 431/79

*Primary Examiner*—James C. Yeung

*Attorney, Agent, or Firm*—John Russell Uren

[57] ABSTRACT

A control system controls a combustion burner. The system has an ignition electrode to create a flame in a burner, and a first temperature sensor to sense the temperature of the flame. A control terminates the operation of the ignition electrode when a predetermined temperature is sensed by the temperature sensor.

8 Claims, 10 Drawing Sheets

CONTROL UNIT FOR BURNER ASSEMBLY

INTRODUCTION

This invention relates to a burner assembly for a heater and, more particularly, to a blue flame burner assembly which is of cylindrical configuration and which is operable with a variety of fuels.

BACKGROUND OF THE INVENTION

It is desirable in a burner to have as high an efficiency as possible since, traditionally, burner efficiency is relatively low. In burners such as the burner shown U.S. Pat. No. Re. No. 28,679, naming the same inventor, a horizontally positioned grid burner is utilised. The use of such a burner in certain applications has an efficiency that is relatively low. Further, such a burner configuration is inoperable for practical purposes where a horizontal rather than a vertical configuration for the heat exchanger is required.

Yet another disadvantage with existing burner assemblies is that unnecessary electrical power can be consumed in ignition. Ignition utilises electrical discharge from the battery or batteries connected to the ignition electrode and the discharge occurs until the temperature for self sustained combustion is reached. In previous heaters, ignition was independent of the temperature of the burner and operated for a predetermined time period. Since the temperature for self sustained combustion may be reached much more quickly when the burner is warm, the additional time for electrode operation was frequently unnecessary and the electrical current expended from the battery is wasted. A further problem with the aforementioned timed electrode discharge is that the burner can become dangerously hot.

Yet a further disadvantage of previous burners is that there is no means to measure whether the flame in the burner is luminous or not. It is desirable in combustion burners to keep the flame blue. This is so since the carbon material created from a blue flame will be minimal or non-existent. If the flame turns luminous, carbon is created which reduces the efficiency of the burner.

Yet a further disadvantage of previous burners and, in particular, the burner disclosed and illustrated in the above-identified U.S. Reissue patent, is that the flame illustrated just inside the end wall tended to be unstable under certain conditions, particularly where the air flow was high. If a burner flame is not stable, it can lift off the burner grid and, thereby, reduce the efficiency of the burner. Yet a further disadvantage of heaters wherein the flame lifts off the burner grid is that carbon monoxide can be produced which is harmful and possibly dangerous.

SUMMARY OF THE INVENTION

According to one aspect of the invention, there is provided a burner assembly comprising a cylindrical burner tube having a longitudinal axis, at least one flame grid for said burner tube, said flame grid extending around the circumference of said burner tube, a nozzle assembly to supply a fuel and air mixture and an ignition electrode to increase the temperature of said burner assembly to a self-sustaining combustion value and to ignite said fuel and air mixture.

According to a further aspect of the invention, there is provided a burner assembly comprising a cylindrical burner tube, a burner jacket surrounds said burner tube, a burner cap extending between said burner jacket and said burner tube, at least one flame grid for said burner tube, one of said flame grids being located adjacent said burner cap within said burner jacket and a flame retention barrier extending outwardly from said burner tube and being located between said flame grid and said burner cap.

According to yet a further aspect of the invention, there is provided a control system for a combustion burner comprising ignition electrode means operable to create a flame in said combustion burner, first temperature sensing means to sense the temperature of said combustion burner and first control means to terminate operation of said ignition electrode when a predetermined temperature is sensed by said temperature sensing means.

According to yet a further aspect of the invention, there is provided a control system comprising a flame rod producing a first signal voltage upon ignition of said control system, means to provide comparison between said signal voltage and upper and lower reference voltages, said signal voltage being within the range of said upper and lower reference voltages by a first predetermined amount, a burner operable to reduce said first signal voltage as the operating temperature of said burner increases, means to reduce said upper and lower signal reference voltages as said first signal voltage is reduced, said first reference voltage being operable to stay within said range of said upper and lower signal reference voltages as said first reference voltage is reduced and means to terminate operation of said burner if said first signal voltage changes such that said first signal voltage is outside of the range of said upper and lower reference voltages.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
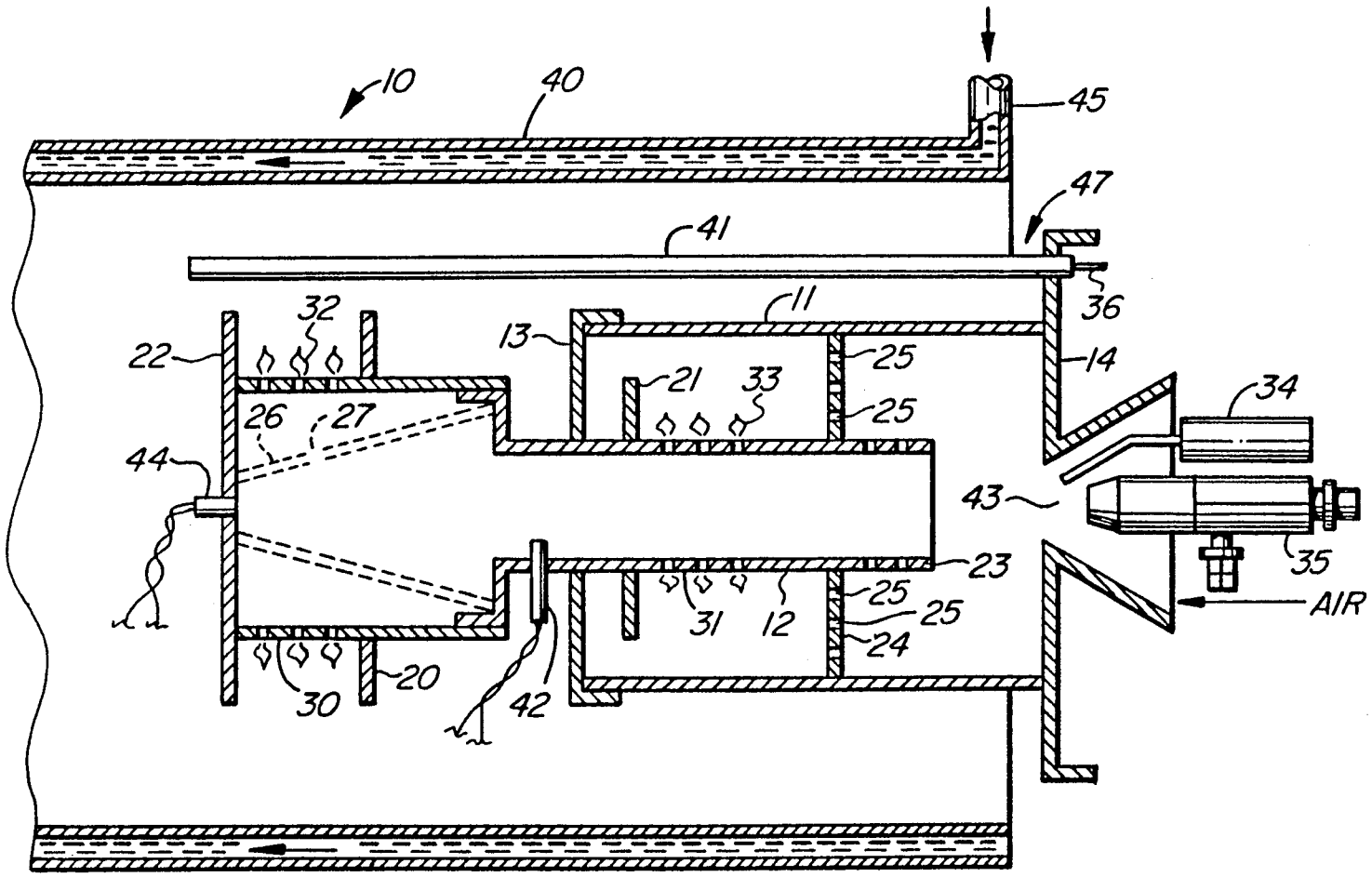
FIG. 1 is a side sectional view of a burner assembly according to the invention being mounted within a water jacket.

Reference is now made to the drawings and, in particular, to FIG. 1 where a burner assembly is generally illustrated at 10. It comprises a burner jacket 11, an inner burner tube 12, a burner cap 13, all of which is attached to a wall 14 on which the burner assembly 10 is mounted.

A water jacket 40 is located coaxial with and surrounds the burner tube 12 and the burner jacket 11. Water circulates under pressure through the water jacket 40 and enters the water jacket 40 at inlet 45.

Three flame retention barriers 20, 21, 22 are connected to the circumference of the burner tube 12, barrier 22 being solid, connected to the end of the burner tube 12 and extend outwardly therefrom. Barrier 20 is also solid with the exception of a hole which allows the burner tube 12 to pass therethrough and is connected to the burner tube 12 between the burner cap 13 and the end barrier 22. Barrier 21 is also solid with the exception of a hole allowing the burner tube 12 to pass therethrough and is connected to the burner tube 12 between the burner cap 13 and the inner end 23 of the burner tube 12.

A first flame arrestor plate 24 is connected between the burner tube 12 and the jacket 11. Holes 25 extend axially through the flame arrestor plate 24. A second flame arrestor plate 26 is mounted within the burner tube 12. It includes a light off hole 27. A corresponding light off hole 28 is also present in the flame grid 30. The purpose of the light off holes 27, 28 is to allow the ignition flame to light the fuel on the flame grid 30.

The burner tube 12 is cylindrical in configuration and has two flame grids 30, 31 which are perforate and extend around the circumference of the burner tube 12 in the locations indicated. The grids 30, 31 allow the release of fuel vapour which ignites and burns on the outside of the flame grids 30, 31. The flame 32, 33 on grids 30, 31, respectively, burns blue and non-luminous.

An ignition electrode 34 and a fuel nozzle assembly 35 are each mounted on the side of wall 14 opposed from the burner tube 12. The ignition electrode 34 is connected to a source of power such as a battery and under the control of a circuit, is used to ignite the fuel prior to the burner assembly reaching its self-sustaining combustion temperature as will be described in detail hereafter. The fuel nozzle assembly 35 is used to vaporize the fuel used to sustain the combustion also as described in greater detail hereafter.

The cylindrical water jacket 40 carries the water to be heated by the burner assembly 10. The water circulating through the jacket 40 exits the jacket 40 following heating and is routed to the area where the heat is required to be radiated.

Two thermocouples 42, 44 are utilised. Thermocouple 42 is mounted through burner tube 12 at the position indicated just outside of the burner cap 13 and before the location of the flame retention barrier 21. Thermocouple 44 is mounted directly to the flame retention barrier 22. Each thermocouple 42, 44 is sensitive to the temperature in its area and each of the thermocouples 42, 44 has its resistance monitored by the control circuit illustrated in FIGS. 2A–2H for the burner assembly 10. Thermocouple 42 senses the heat generated by the flame which is created by operation of the ignition electrode 34.

Thermocouple 44 monitors the temperature at the burner cap 22 up to 1000 deg. F. Once that temperature is reached, the thermocouple 44 terminates the operation of the ignition electrode 34 through the control circuit as is also described in more detail hereafter.

The flame rectification system generally indicated at 47 comprises a conductive rod 41 which is mounted in the wall 14. A contact 36 is connected to the end of conductive rod 41 for connection to a source of electrical power. The conductive rod 41 allows a current to pass through the rod 41 and the flame 32 to ground. In the absence of a flame, no circuit is established and the control circuit will activate fuel termination as described in more detail hereafter.

A thermostat (not shown) is connected to the outlet (not shown) of the water jacket 40. It monitors the temperature of the water within the water jacket 40 and is operable through the control circuit to commence the operation of the burner assembly 10 when the water temperature reaches a certain level.

Figure 2A:
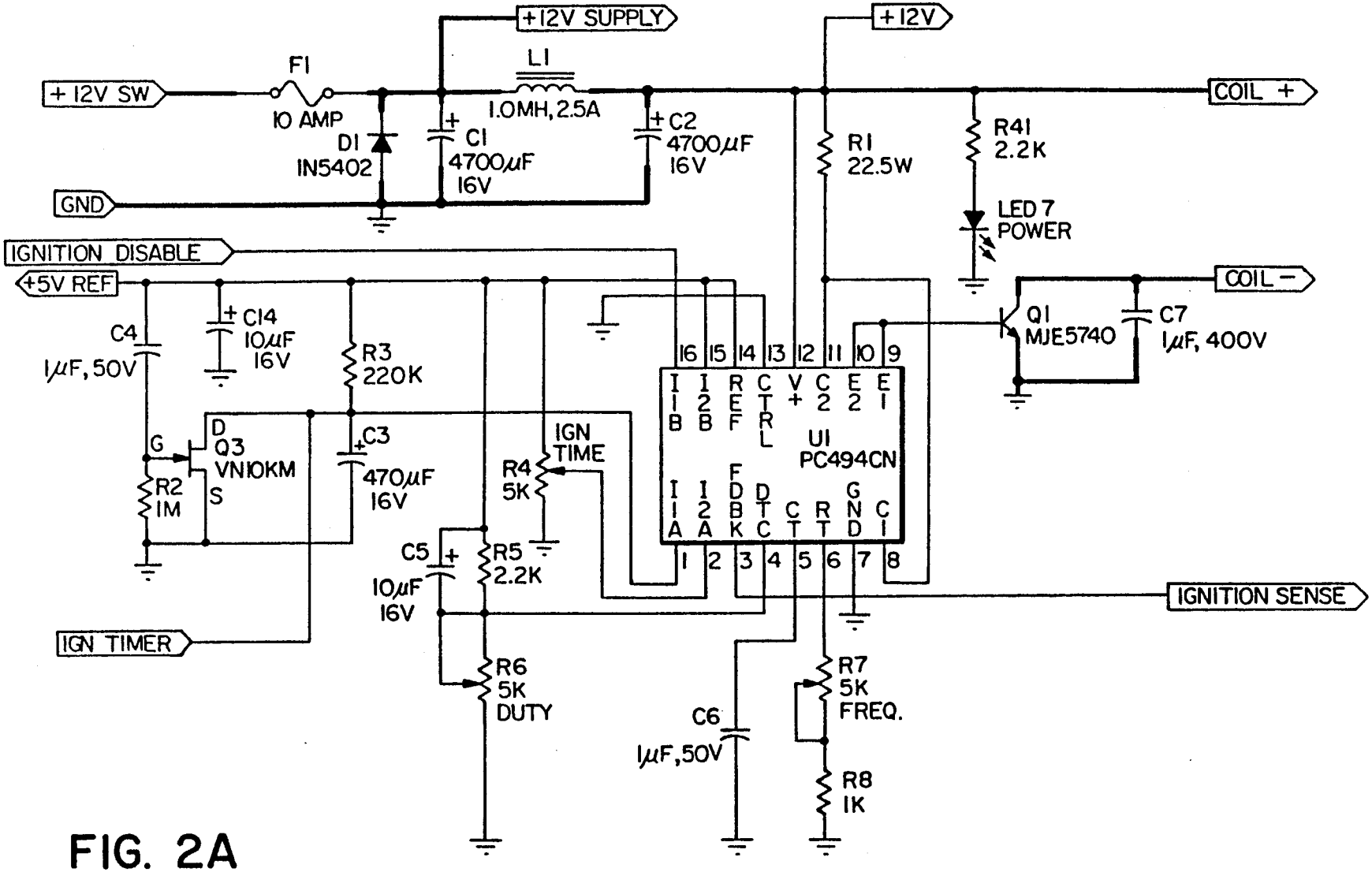
FIGS. 2A through 2H are schematic diagrams of the electronic control circuit which controls the operation of the burner assembly.

With regard to FIG. 2A, an ignition circuit is indicated generally at 50. The ignition circuit 50 comprises a power supply circuit 52, a timer circuit 54, and an integrated circuit 56.

Figure 2B:
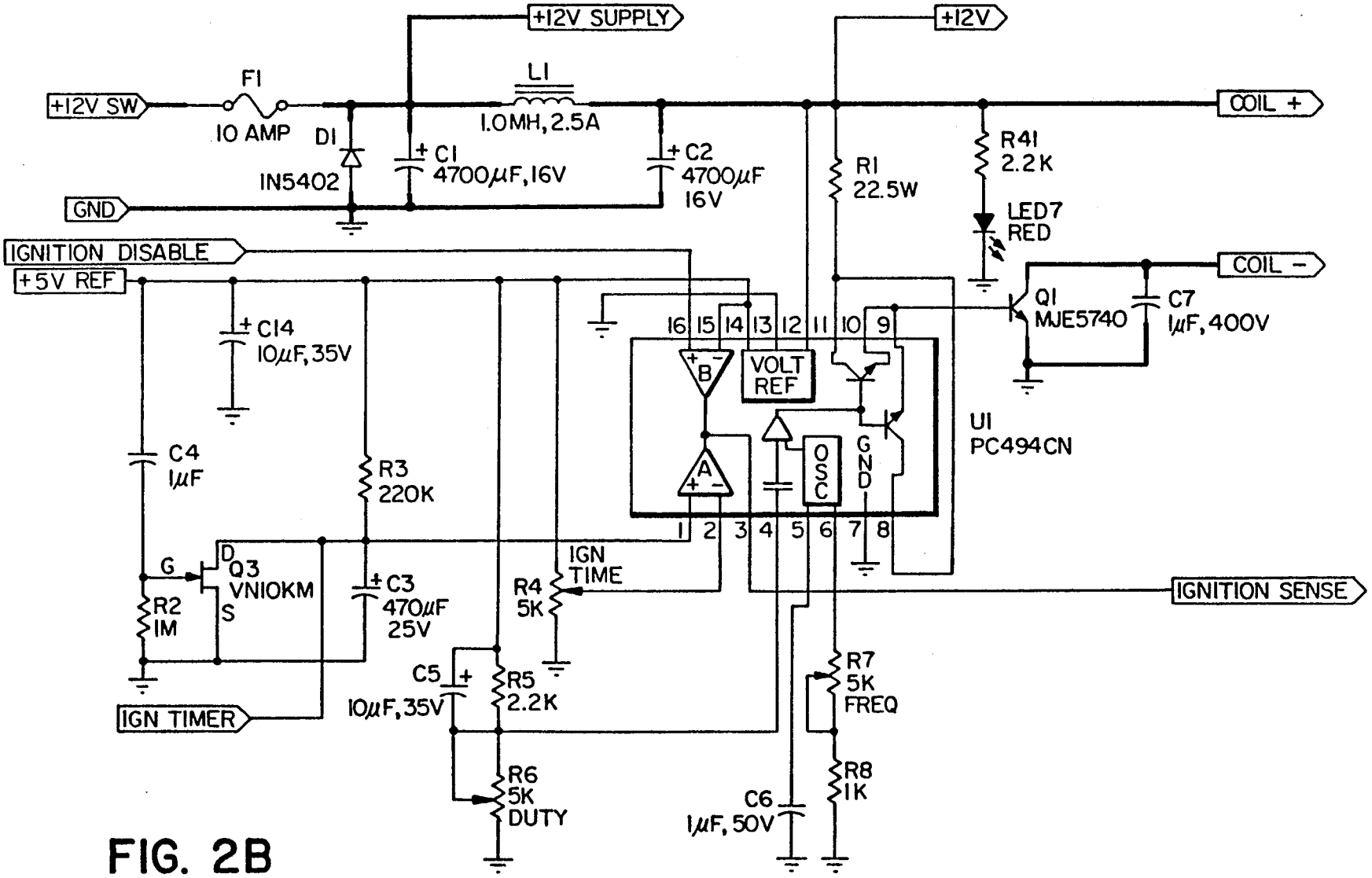

FIG. 2B provides a more detailed view of the integrated circuit 56. The integrated circuit 56 comprises comparator circuits 58 and 60, a voltage reference circuit 62, and an oscillator circuit 64.

Figure 2C:
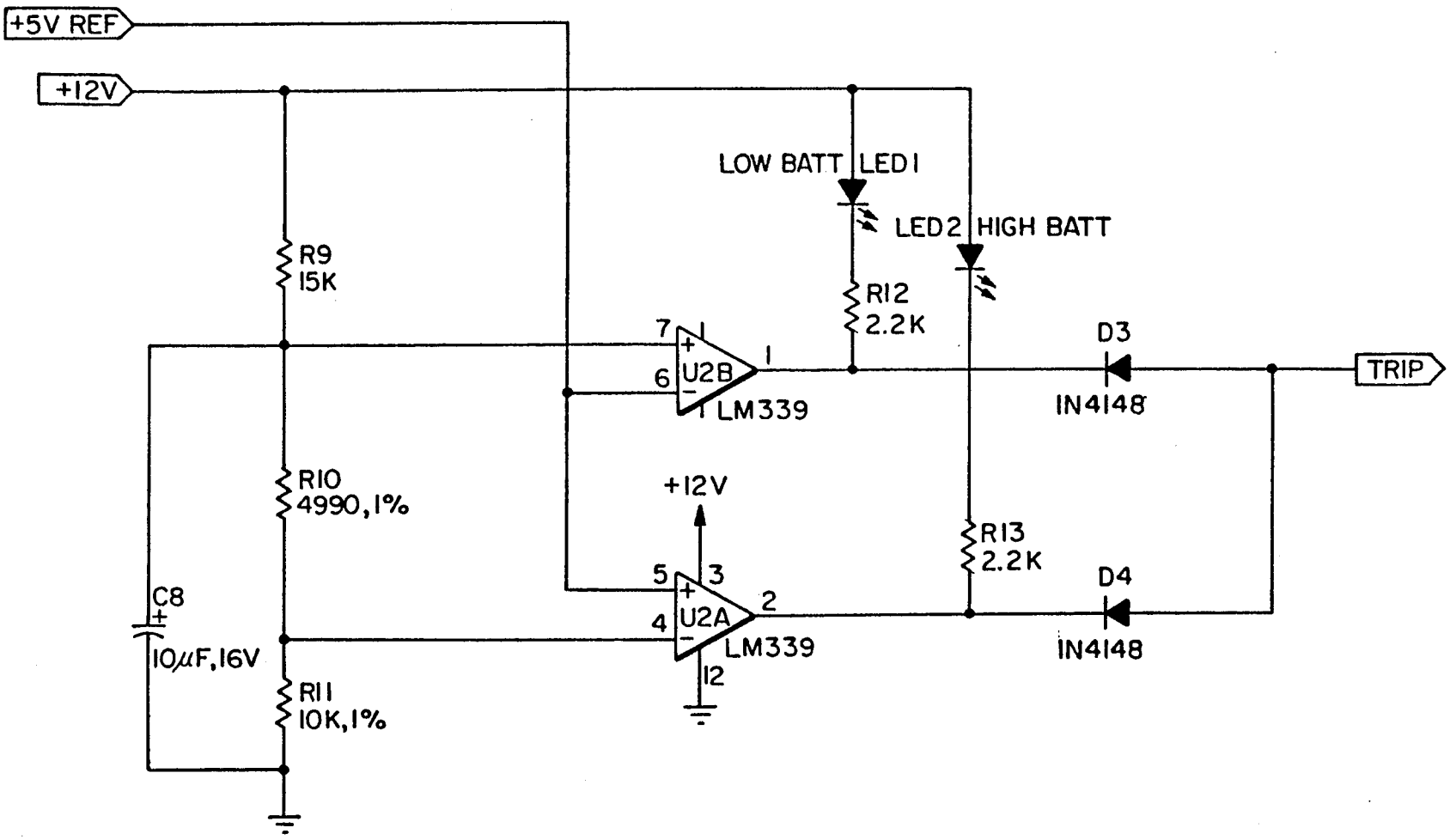

With regard to FIG. 2C, a battery level circuit is indicated generally at 66. The battery level circuit 66 comprises a voltage divider network 68 and comparator circuits 70 and 72.

Figure 2D:
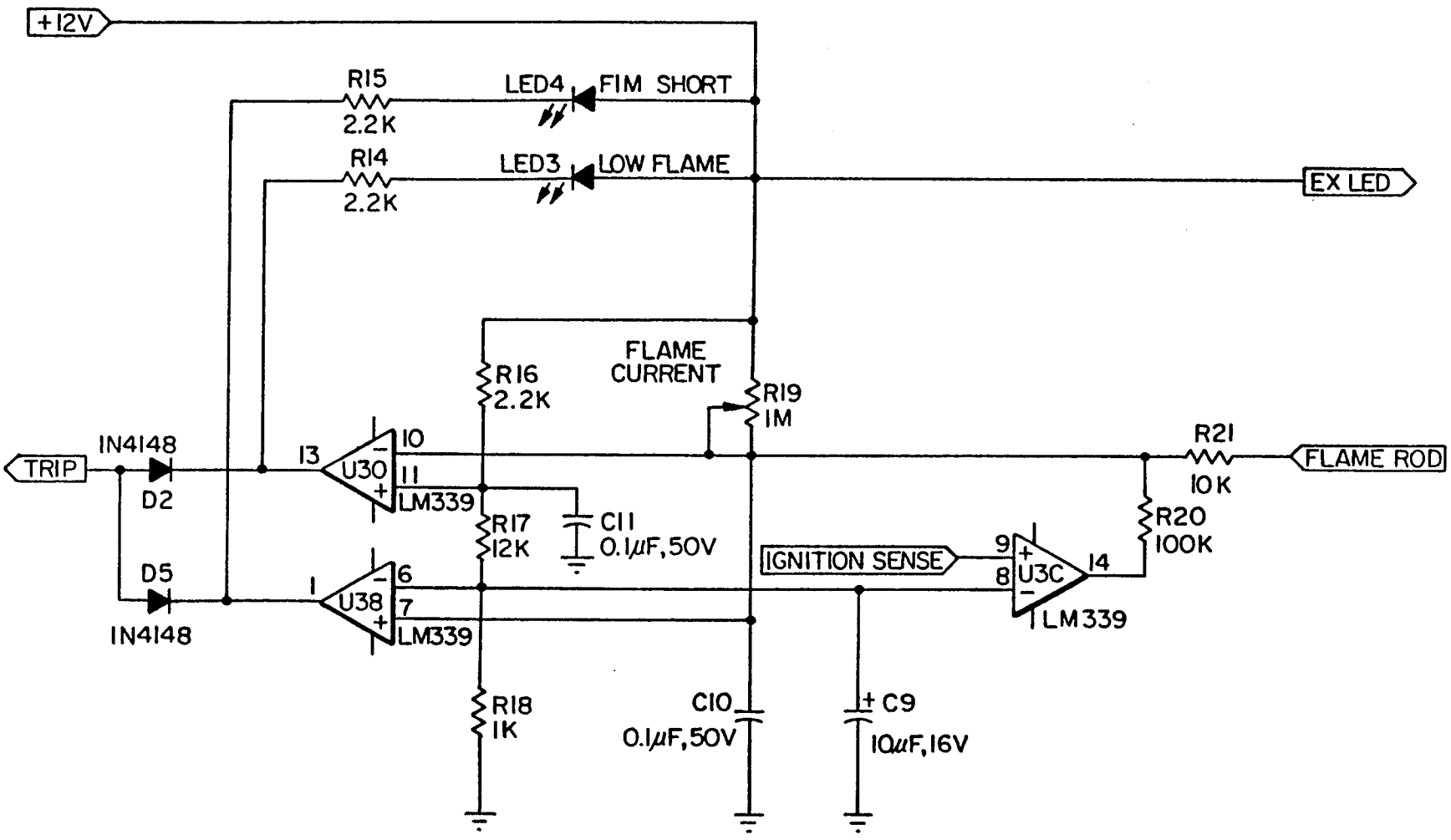

With regard to FIG. 2D, a flame rod sensor circuit is indicated generally at 74. The flame rod sensor circuit 74 comprises comparator circuits 76, 78, and 80, and a voltage divider network 82.

Figure 2E:
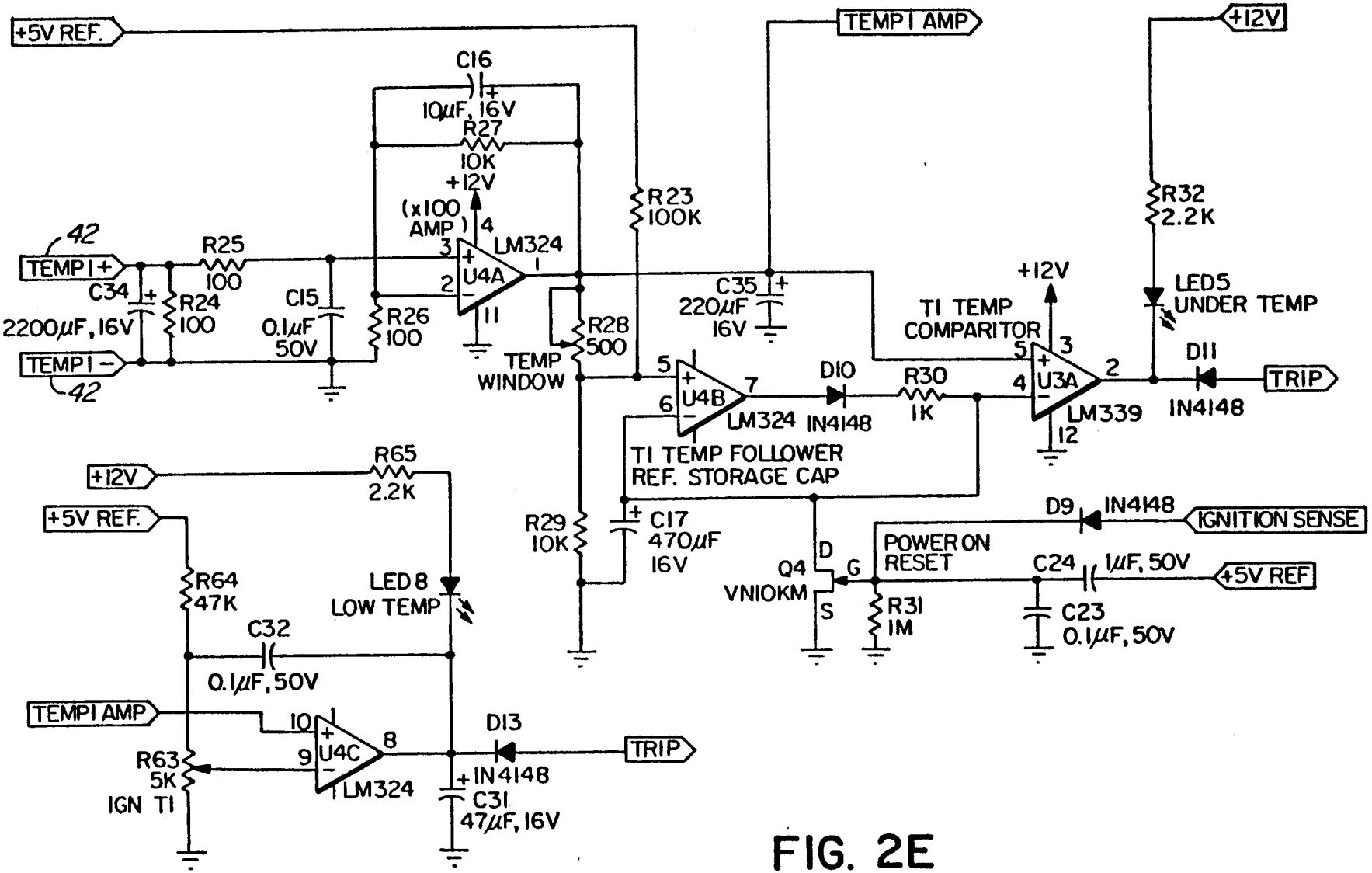

With regard to FIG. 2E, a temperature window and level circuit is indicated generally at 84. The temperature window and level circuit 84 comprises a differential amplifier circuit 86, a comparator circuit 88, a follower circuit 90, a comparator 92, and a temperature window reset circuit 94.

Figure 2F:
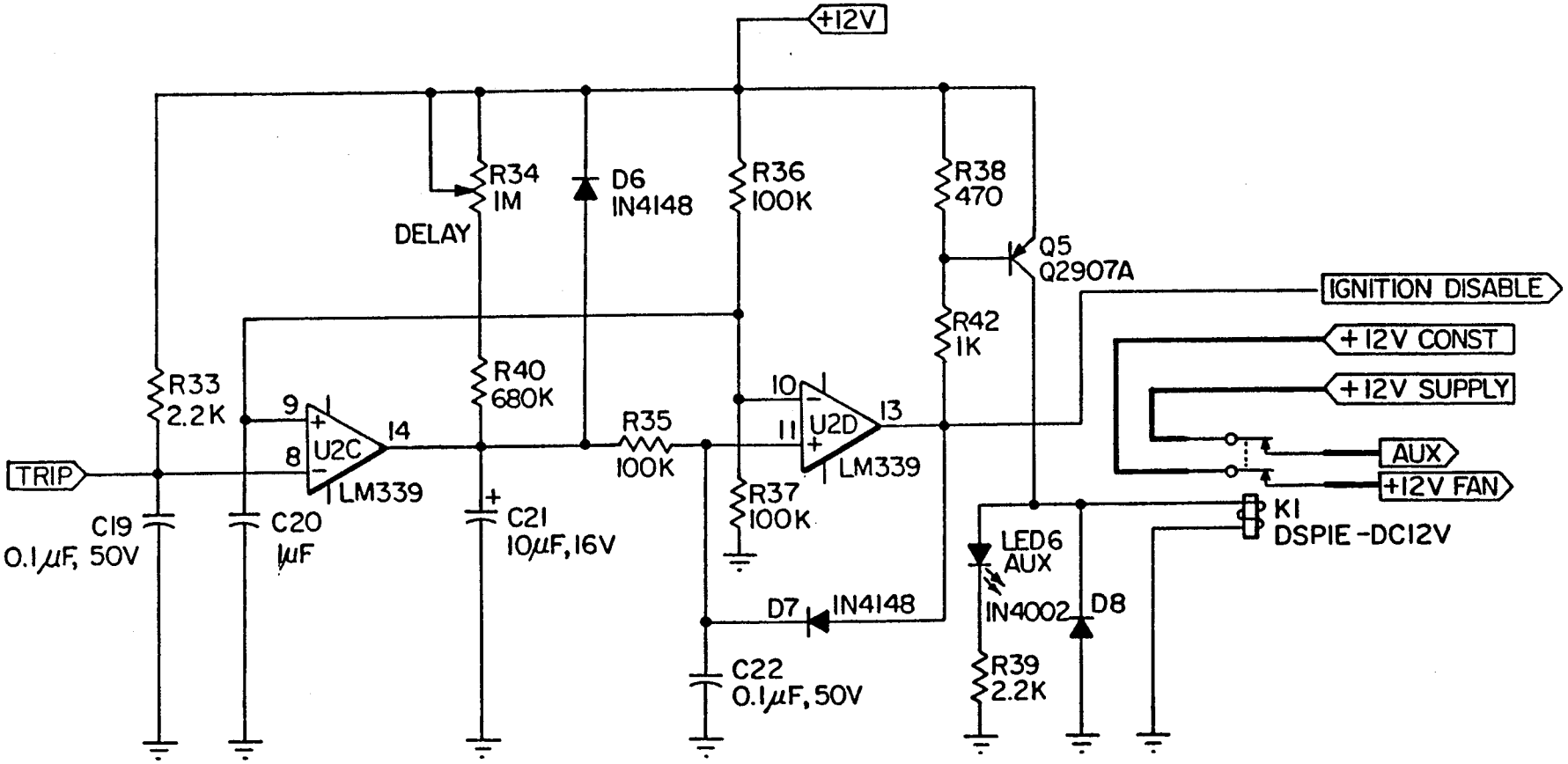

With regard to FIG. 2F, a trip circuit is indicated generally at 96. The trip circuit 96 comprises comparator circuits 98 and 100, a transistor circuit 102, and a relay circuit 104.

Figure 2G:
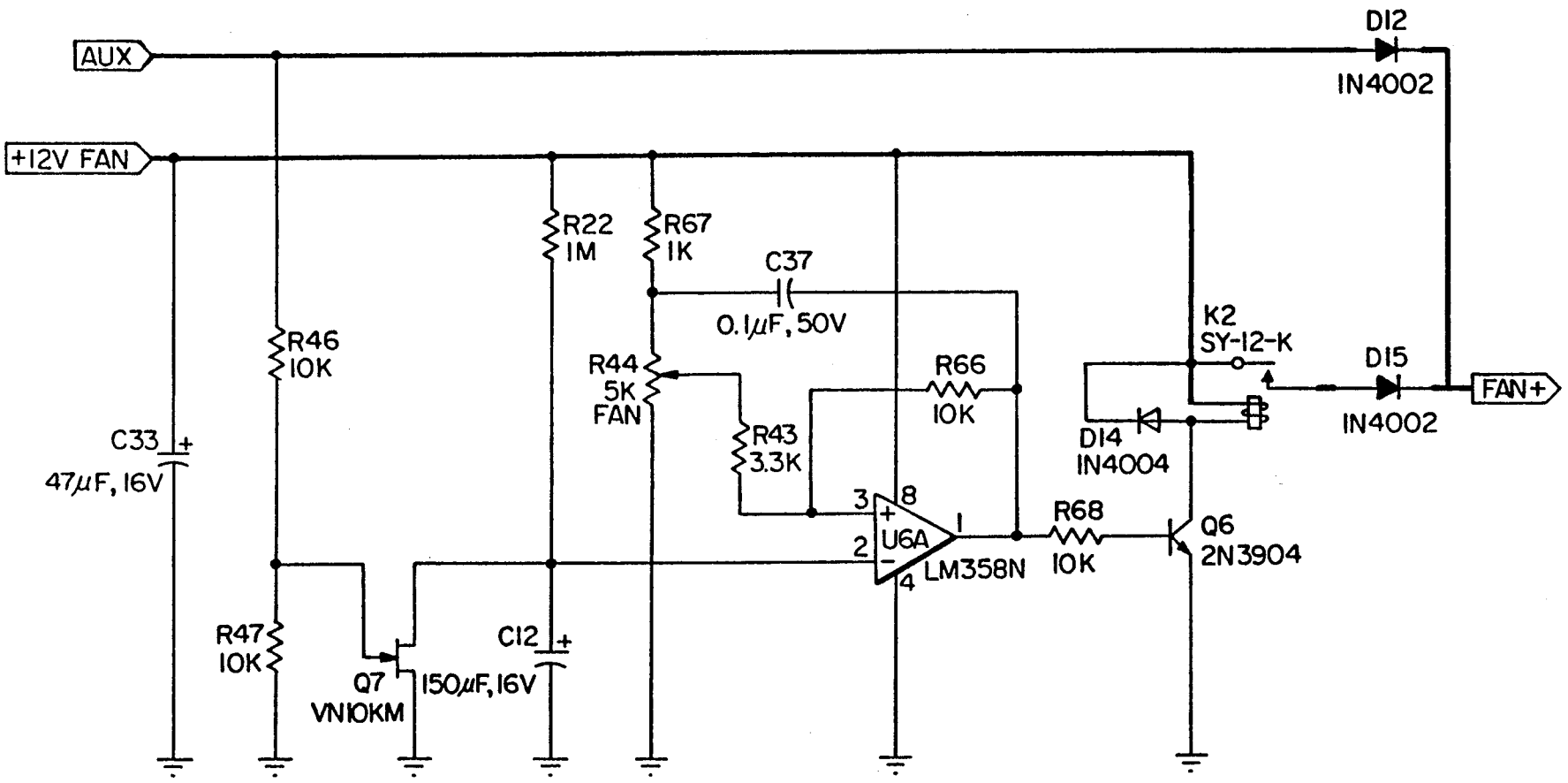

With regard to FIG. 2G, a fan delay circuit is indicated generally at 106. The fan delay circuit 106 comprises a transistor circuit 108, a differential amplifier circuit 110, a transistor circuit 112, and a relay circuit 114.

Figure 2H:
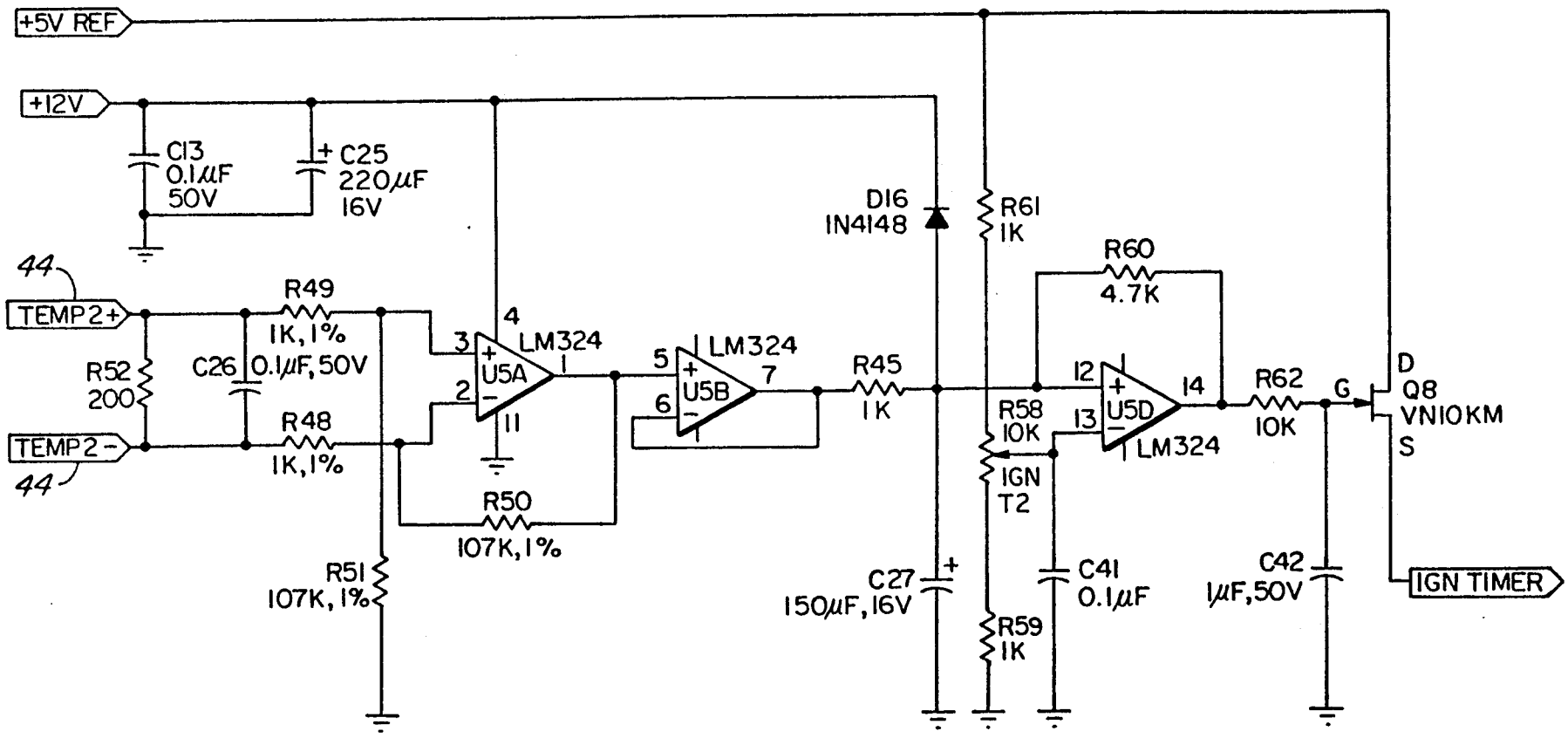

With regard to FIG. 2H, an ignition thermocouple circuit is indicated generally at 116. The ignition thermocouple circuit 116 comprises differential amplifier circuits 118, 120, and 122, a voltage divider network 124, and a transistor circuit 126.

OPERATION

In operation and in order to reach a temperature required for self sustaining combustion, the ignition electrode 34 is activated with power from the battery or other power source (not illustrated). Fuel enters the nozzle assembly 35 where it is vaporized and expelled through the orifice 43 of the nozzle assembly 35. Air enters the burner assembly around the nozzle assembly 35.

The discharge from the ignition electrode 34 is used to ignite the fuel and air mixture from the orifice 43 to create a long tongue flame extending into and substantially the length of burner tube 12 which heats the burner assembly 10 and thermocouples 42, 44. Assuming the fuel air mixture is correct, when the thermocouple 44 reaches a temperature of approximately 1000 degrees Fahrenheit, the thermocouple 44 will act on the control circuit as illustrated in FIG. 2H which will terminate the operation of the ignition electrode 34. This temperature is sufficient for self-sustaining combustion of the fuel and the flame 32 will appear on the grid 30.

The use of thermocouple 44 to sense burner temperature of 1000 deg. F. has a further advantage in the circuit and that is to minimize operation of the ignition electrode 34 and, therefore, power use from a battery for example, if the burner assembly 10 is warm. For example, should the burner assembly 10 be temporarily shut down for only a short period, the time taken for the ignition electrode 34 to make the burner assembly 10 reach a temperature of 1000 deg. F will clearly be considerably shorter than if the burner assembly 10 is starting from a cold, long shutdown state. Thus, only the most efficient use of battery power is made to reach the self sustaining temperature value required for continued operation of the burner assembly 10.

Thermocouple 42 senses the presence of the flame within the burner tube 12 after operation of the ignition electrode 34 is initiated. If no heat (and, therefore, flame) is present, due to the absence of fuel or for other operating reasons, the thermocouple 42 will act through the control circuit of FIG. 2E to shut down the burner assembly within two (2) to four (4) seconds. Likewise, should the temperature sensed by thermocouple 42 decrease such as would be the case if the flame initially was present but, thereafter, it slowed down because of lack of fuel for example, the thermocouple 42 will likewise terminate the operation of the burner assembly.

A certain temperature window is also created by the control circuit in association with thermocouple 42. The temperature window is a change in voltage from the thermocouple of approximately one (1) mv which translates into approximately 50 to 100 deg. F. This window follows the temperature rise of the thermocouple 42 and, so long as the temperature sensed by the thermocouple 42 falls within this temperature window, the burner assembly 10 will continue operation. Otherwise, the control circuit will shut down the burner assembly operation.

Assuming the burner assembly 10 is operating correctly and thermocouple 44 senses the required 1000 deg. F. temperature, thermocouple 42 is then disarmed from the control circuit and the temperature window is reset.

A third control is the timer circuit 54 illustrated in the control circuit of FIGS. 2A and 2B. Timer 54, the time period of which is adjustable through potentiometer R4 (FIG. 2B), overrides both thermocouples 42, 44. The timer 54 commences operation upon initial operation of the ignition electrode 34 and acts, if the ignition electrode 34 is not terminated within an adjustable time period typically ranging from thirty (30) to one hundred twenty (120) seconds, the timer 54 will terminate shuts down the operation of the ignition electrode 34. If the electrode 34 is shut down and the flame rectification system senses a flame 32 on grid 30, as will be described in greater detail below, the fuel will continue to flow as the burner assembly is deemed to be operating correctly. The timer 54 is, therefore, a fail-safe device which provides for system shutdown if there is no flame 32 on the grid 30 after a predetermined time period.

The flame rectification system 47 which consists of the conductive rod 41 mounted in wall 14 with the connection 36 to a power source (not shown) takes over system control as soon as thermocouple 44 reaches a temperature of 1000 deg. F. and the ignition circuit is therefore shut down. If a flame is sensed and continues to be sensed thereafter, fuel will continue to flow. If a flame suddenly disappears or if the flame becomes luminous, the flame rectification system 47 through the control circuit illustrated in FIG. 2D will terminate fuel flow to the burner assembly 10. This is a safety as well as an efficiency measure since fuel flow would otherwise continue to flow and, upon shutdown and eventual subsequent reignition, excess fuel within the burner assembly 10 which had been previously provided would be required to be burned off.

During the operation of the burner assembly 10, a blue flame 32, 33 will emanate from the flame grids 32, 31, respectively. The blue flame 32, 33 will extend completely around the circumference of the burner tube 12 and will radiate heat outwardly toward the jacket 40 in order to heat the water being circulated therethrough.

The flame retention barriers 20, 21, 22 act to keep the blue flames 32, 33 on the respective flame grids 30, 31 of the burner tube 12 which allows for a more efficient combustion of the fuel and further allows the flame to burn well with a higher velocity forced air draft which may be natural or induced by a fan, for example.

A further control by way of a thermostat (not shown) monitors the temperature of the water in the water jacket 40 during operation. Should the temperature of the water in jacket 40 exceed 185 deg. F., the burner assembly 10 will shut down, When the temperature reaches 160 deg. F., the burner assembly 10 will again commence operation in accordance with the operation of the ignition electrode 34 and subsequent elements as described earlier.

Dimensions of a typical burner assembly 10 according to the invention include an outside diameter for the burner tube 12 of approximately 1¾ inches and a diameter of the flame retention barriers 20, 22 of approximately 3¼ inches. The length of the burner tube 12 is approximately 6 inches and the diameter of flame retention barrier 21 is approximately 2½ inches. The outside diameter of the burner jacket 11 is approximately 3½ inches and the length of the burner jacket 11 from the wall 14 is approximately 5¼ inches.

With such dimensions, it has been found that the burner assembly 10 will produce approximately 35000 BTU/hour of operation. It has been found that with this heat output, approximately 30 gallons of water/hour will be heated with approximately a 100 deg. F. temperature rise.

The electrical system used to power the burner assembly is a 12 volt system but it may be operated from a 24 or 110 volt system as well with the proper choice of components in the control system.

With regard now to FIGS. 2A through 2H, a more detailed operation of the electronic circuitry will be presented.

With regard to FIGS. 2A and 2B, the power supply circuit 52 provides d.c. power to both the electronic and the electric portions of the circuitry. The timer circuit 54, as adjusted by R4, determines the maximum length of time that the ignition electrode 34 will be turned on. The integrated circuit 56 performs three functions. First, it provides a +5 v reference voltage using circuit 62. Second, using oscillator circuit 64, it provides a variable duty cycle oscillating signal to control the ignition electrode 34. Finally, it provides a feedback signal IGNITION SENSE to the ignition sensor circuitry (see FIGS. 2D and 2E) based upon the state of the timer circuit 54, the IGNITION DISABLE signal (see FIG. 2F), and the IGNITION TIMER signal (see FIG. 2H).

The IGNITION SENSE signal means that there is reason to turn off the ignition electrode 34. The IGNITION SENSE signal will be low when the timer circuit 54 is initialized. As time passes, the voltage across capacitor C3 will exceed the voltage tapped at potentiometer R4 and the output of the comparator 58 (IGNITION SENSE) will go high. The IGNITION SENSE signal will also go high if the comparator 58 detects the IGNITION TIMER signal or the comparator 60 detects the IGNITION DISABLE signal.

With regard to FIG. 2C, the voltage of the source battery (not shown) is divided across voltage divider 68. The comparator circuits 70 and 72 both naturally output a digital high signal. If the voltage of the source battery (not shown) falls below a tolerance determined by the resistors used in the divider network 68, then the output of the comparator 70 goes low, LED1 indicates a LOW BATT condition, and a TRIP signal is initiated. If the voltage of the source battery (not shown) rises above a tolerance determined by the resistors used in the divider network 68, then the output of the comparator 72 goes low, the LED2 indicates a HIGH BATT condition, and a TRIP signal is initiated.

With regard to FIG. 2D, when a burner flame 32 exists, an electric circuit is established along the flame rod 41, through the flame 32, to ground. The flame rod sensor circuit 74 detects two conditions. It detects when there is no conducting path (i.e. the flame 32 has been extinguished) and when there is a perfect conducting path (i.e. the flame rod 41 has short circuited). Voltage divider network 82 tests both of these conditions. When there is a minimal flame current, the negative input to the comparator 80 (as adjusted by R19) will exceed the positive input and the output will go negative, LED3 will indicate a LOW FLAME condition, and a TRIP signal will be initiated. When there is an overly large flame current, the negative input of the comparator 78 will exceed the positive input and the output will go negative, LED4 will indicate a FLM SHORT condition, and a TRIP signal will be initiated. The comparator circuit 76 provides a feedback path for the IGNITION SENSE signal.

With regard to FIG. 2E, the processing of the signal from thermocouple 42 is illustrated. The faint signal is first amplified by the differential amplifier circuit 86. Then the amplified signal is processed by two separate circuits.

First, the comparator circuit 88 compares the amplified signal against an absolute temperature as adjusted by R63. If the amplified signal represents a lower temperature, the comparator circuit 88 goes low, LED8 indicates a LOW TEMP condition, and a TRIP signal is initiated.

Second, the follower circuit 90 sets a relative temperature window that rises with the actual signal measured by thermocouple 42. If the amplified signal dips below this window region, the comparator circuit 92 goes low, LED5 indicates an UNDER TEMP condition, and a TRIP signal is initiated. If an ignition sense signal is received by the temperature window reset circuit 94, capacitor C17 is discharged through the transistor Q4 and the window region is reset.

With regard to FIG. 2F, the actual trip circuitry is generally indicated at 96. When a TRIP signal is received, the comparator circuit 98 changes state, driving the RC network formed by variable resistor R34, resistor R40, and capacitor C21. After an RC time delay, comparator 100 changes state, initiates an IGNITION DISABLE signal, and forces transistor 102 into conduction. LED6 indicates a TRIP condition, and relay 104 switches, sending power to a fan and initiating an AUX signal.

With regard to FIG. 2G, the initiation of the AUX signal forces transistor 108 into conduction which, subject to the discharge time delay of C12, lowers the negative input of differential amplifier 110 with respect to the positive input. The voltage at the output of differential amplifier 110 increases and which forces transistor 112 into conduction which switches relay 114.

With regard to FIG. 2H, the processing of the signal from thermocouple 44 is illustrated. The signal is first amplified and buffered by differential amplifiers 118 and 120. The amplified signal is compared with an absolute reference using voltage divider 124 and differential amplifier 122. When the thermocouple temperature exceeds the reference signal, the differential amplifier 122 goes high, and transistor 126 conducts, initiating an IGNITION TIMER signal.

Many modifications are contemplated to the specific embodiment described. For example, although a water jacket 40 has been described, the jacket of course could heat air or various other liquids. The burner assembly 10 is designed to operate from a variety of fuels including diesel fuel, propane, jet fuel, gasoline and fuel oil without the need for changing the nozzle assembly 35, its orifice 42 or making any other adjustments to the burner assembly 10.

Figure 3:
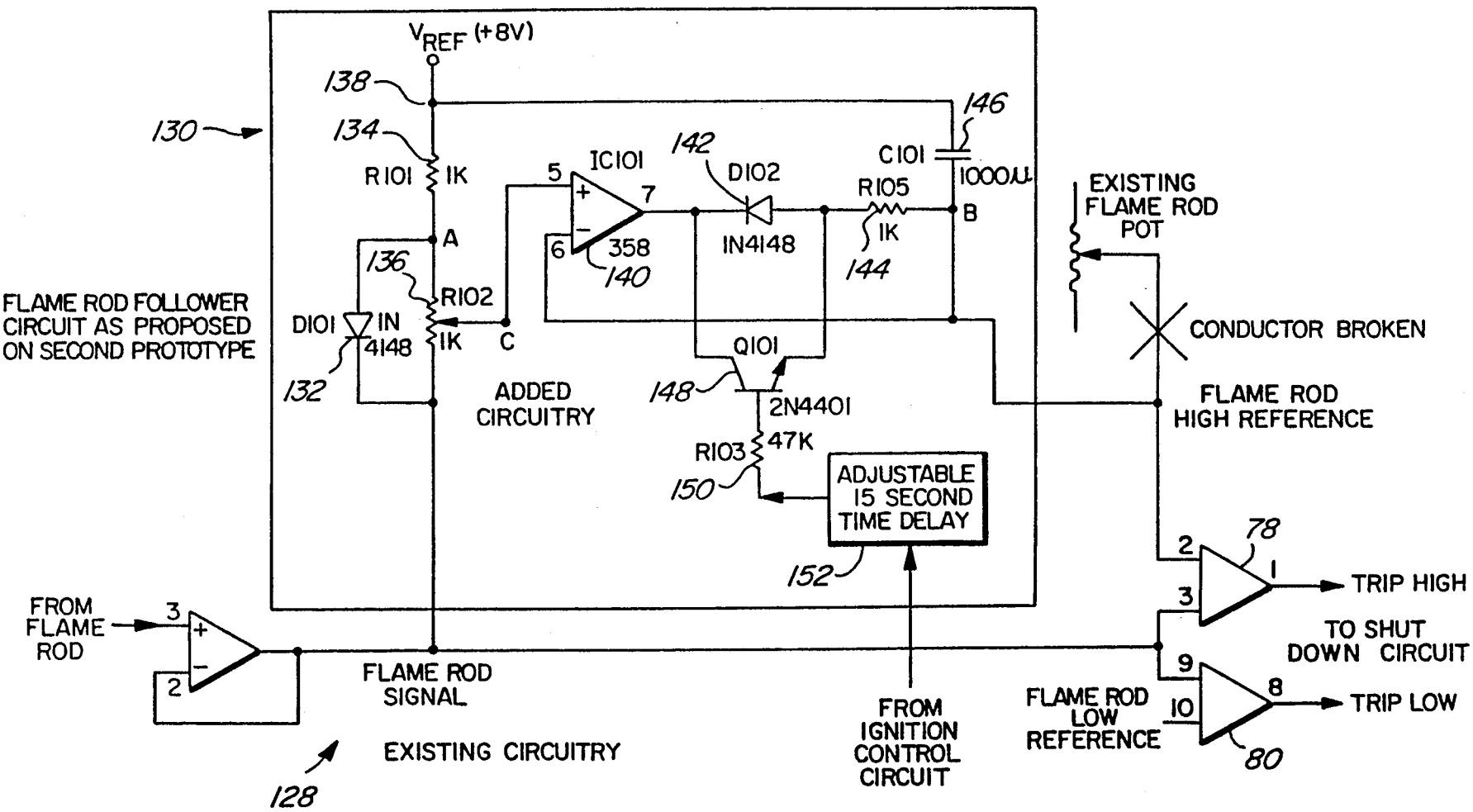
FIG. 3 is a schematic diagram of a further embodiment of the control system according to the invention.

In yet a further embodiment, the flame rod 41 senses the flame by measuring the voltage being passed from the flame rod 41 to the burner 10 through the flame 32. This technique is accomplished with reference to FIG. 3.

An improved flame rod sensor circuit according to this embodiment is illustrated generally at 128. It comprises comparator circuits 78, 80, and dynamic high voltage reference circuit 130. The signal from flame rod 41 is applied to comparator 80 which sets a lower limit and to comparator 78 which sets the upper limit. The lower limit of comparator 80 is set by a fixed low voltage reference. The upper limit of comparator 78 is set by a dynamic high voltage reference produced by circuit 130. The dynamic high voltage reference is equal to the lowest value obtained by the signal from flame rod 41 plus a preset offset value. Diode 132, resistor 134, and potentiometer 136 divide the potential difference between a reference 138 and the signal from flame rod 41. The potentiometer 136 therefore delivers an input signal equal to the signal from flame rod 41 plus a preset offset to a negative peak detector circuit comprised of an op-amp 140, a diode 142, a resistor 144 and a capacitor 146. The output of the negative peak detector circuit forms the dynamic high voltage reference applied to comparator 78. When the burner 10 is initially ignited, the initial charging of capacitor 146 is facilitated by transistor 148, resistor 150, and timer circuit 152 which responds to a signal from the ignition control circuit of FIG. 2A.

In operation and after ignition is terminated, the voltage reading assumes its highest point, say 5 volts. As the burner 10 begins to warm up the voltage starts to drop and may eventually reach 2.5 volts. The circuit illustrated in FIG. 3 will therefore allow burner 10 to follow the decreasing voltage with a window such that as long as the voltage stays within the window, the operation of the burner 10 will continue. Thus, as long as the voltage continues to drop, or remain constant, the burner 10 will continue operating. If at any time the voltage should rise, say 0.5 volts, which would put it outside or above the window, and stay there for the time it takes the safety circuit to shut down the burner 10, the burner 10 will terminate operation. Such a rise in voltage could indicate a malfunction in the burner operation, such as unacceptable luminosity.

Many other modifications will readily occur to those skilled in the art and the specific embodiment herein described should be considered to be illustrative of the invention only and not as limiting its scope as defined in accordance with the accompanying claims.

What is claimed is:

1. In a combustion burner having a burner tube and ignition electrode means for creating a primary flame inside said burner tube which primary flame extends longitudinally of said burner tube during ignition of said combustion burner and said burner tube having a circumferentially extending flame grid thereon for accommodating a secondary flame on the outside of said burner tube during self-sustaining combustion in the burner, a control system comprising temperature sensing means for sensing the temperature of said primary flame inside said burner tube created by said ignition electrode means and first control means for terminating operation of said combustion burner during said ignition when said temperature of said primary flame is not sensed and flame monitoring means for monitoring the presence of said secondary flame on the outside of said burner tube and second control means for terminating the operation of said combustion burner when the presence of said secondary flame is not sensed.

2. The control system according to claim 1, wherein said flame monitoring means comprises a flame rod for establishing an electric circuit along said flame rod and through said secondary flame to ground.

3. The control system according to claim 2, wherein said temperature sensing means comprises a thermocouple.

4. The control system according to claim 3, further comprising timer means for terminating the operation of said ignition electrode means after a predetermined time period.

5. The control means according to claim 2, wherein said flame rod produces a signal voltage upon ignition of said combustion burner which signal voltage decreases as the operating temperature of said combustion burner increases, and further comprising comparison means to provide comparison between said signal voltage and upper and lower reference voltages, said signal voltage being within the range of said upper and lower reference voltages, and voltage reduction means for reducing said upper and lower reference voltages as said signal voltage is reduced and wherein said second control means terminates the operation of said combustion burner if said signal voltage changes such that said signal voltage is outside the range of said upper and lower reference voltages.

6. A control system as in claim 5 wherein said signal voltage falls upon termination of said ignition.

7. A control system as in claim 6 wherein said signal voltage falls outside said range between said upper and lower reference voltages if said signal voltage rises.

8. A control system as in claim 6 wherein said signal voltage falls within said range between said upper and lower reference voltages if said signal voltage remains constant or decreases.

* * * * *